US010183842B2

(12) United States Patent
Müller et al.

(10) Patent No.: US 10,183,842 B2
(45) Date of Patent: Jan. 22, 2019

(54) ELEVATOR INSTALLATION

(71) Applicant: ThyssenKrupp Elevator AG, Essen (DE)

(72) Inventors: Jörg Müller, Deizisau (DE); Holger Zerelles, Leinfelden-Echterdingen (DE); Bernd Altenburger, Neuhausen (DE); Ronald Dietze, Leinfelden-Echterdingen (DE); Juri Schäfer, Stuttgart (DE)

(73) Assignee: THYSSENKRUPP ELEVATOR AG, Essen (DE)

( * ) Notice: Subject to any disclaimer, the term of this patent is extended or adjusted under 35 U.S.C. 154(b) by 107 days.

(21) Appl. No.: 15/025,822

(22) PCT Filed: Sep. 30, 2014

(86) PCT No.: PCT/EP2014/002651
§ 371 (c)(1),
(2) Date: Mar. 29, 2016

(87) PCT Pub. No.: WO2015/043765
PCT Pub. Date: Apr. 2, 2015

(65) Prior Publication Data

US 2016/0251202 A1 Sep. 1, 2016

(30) Foreign Application Priority Data

Sep. 30, 2013 (DE) ..... 10 2013 110 778

(51) Int. Cl.
*B66B 7/06* (2006.01)
*B66B 9/00* (2006.01)
*B66B 11/00* (2006.01)

(52) U.S. Cl.
CPC ..... *B66B 11/0095* (2013.01); *B66B 7/068* (2013.01); *B66B 9/00* (2013.01); *B66B 2009/006* (2013.01)

(58) Field of Classification Search
CPC .... B66B 11/0095; B66B 7/068; B66B 11/006
See application file for complete search history.

(56) References Cited

U.S. PATENT DOCUMENTS 1,837,643 A * 12/1931 Anderson ..... B66B 9/00 187/249
1,911,834 A * 5/1933 Lindquist ..... B66B 9/00 187/249

(Continued)

FOREIGN PATENT DOCUMENTS

CN 101090856 A 12/2007
CN 101092220 A 12/2007

(Continued)

OTHER PUBLICATIONS

International Search Report for PCT/EP2014/002651 dated Dec. 17, 2014 (dated Jan. 7, 2015).

*Primary Examiner* — Diem M Tran
(74) *Attorney, Agent, or Firm* — thyssenkrupp North America, Inc.

(57) ABSTRACT

An example elevator system may include a shaft in which a first elevator car and a second elevator car positioned below the first elevator car are separately movable up and down in a vertical direction along a common guideway. The first elevator car may be coupled to a first counterweight by first suspension ropes and by first compensation ropes, and the second elevator car may be coupled to a second counterweight by second suspension ropes and second compensation ropes. Further, first and second ends of the first compensation ropes may be secured to the first counterweight or to the first elevator car. The first compensation ropes may be (Continued)

guided around at least one roller positioned on a bottom surface of the first elevator car or on the counterweight.

14 Claims, 2 Drawing Sheets

(56) References Cited

U.S. PATENT DOCUMENTS

| | | | | | |
|---|---|---|---|---|---|
| 5,509,503 | A | | 4/1996 | Salmon | |
| 5,584,364 | A | * | 12/1996 | Sakita | B66B 7/06 187/249 |
| 5,699,879 | A | * | 12/1997 | Sakita | B66B 11/009 187/249 |
| 7,661,513 | B2 | * | 2/2010 | Kocher | B66B 9/00 187/249 |
| 8,651,241 | B2 | * | 2/2014 | Kocher | B66B 11/0095 187/249 |
| 2008/0302610 | A1 | | 12/2008 | Kocher | |
| 2011/0088980 | A1 | | 4/2011 | Husmann | |

FOREIGN PATENT DOCUMENTS

| | | | |
|---|---|---|---|
| EP | 1935827 | A1 | 6/2008 |
| WO | 2004048243 | A1 | 6/2004 |
| WO | 2006065241 | A2 | 6/2006 |
| WO | 2009080538 | A1 | 7/2009 |

* cited by examiner

ELEVATOR INSTALLATION

CROSS REFERENCE TO RELATED APPLICATIONS

This application is a U.S. National Stage Entry of International Patent Application Serial Number PCT/EP2014/002651, filed Sep. 30, 2014, which claims priority to German Patent Application No. DE 102013110778.8 filed Sep. 30, 2013, the entire contents of both of which are incorporated herein by reference.

FIELD

The present disclosure relates to elevator systems and, more particularly, to elevator systems that employ two cars in one shaft.

BACKGROUND

In order to convey a plurality of persons by means of an elevator installation within a short period, international disclosure document WO 2004/048243 A1 discloses arranging at least two elevator cars in one shaft and moving them vertically up and down separately from one another. Each elevator car has associated therewith a drive device, by means of which the elevator car is able to be driven. Each of the two elevator cars is coupled with a counterweight by means of suspension ropes, the suspension ropes being guided in each case by means of a traction sheave, by means of which the elevator cars are able to be moved.

These types of elevator installations are used, in particular, in very high buildings. In this connection, the tare weight of the suspension ropes or suspension belts can result, in the case of an arrangement of an elevator car at one end of the shaft and the arrangement of the associated counterweight at the other end of the shaft, in the suspension ropes or suspension belts slipping over the traction sheave on account of their own weight. In order to compensate for the weight of the suspension ropes or suspension belts, compensation ropes or compensation belts are consequently disclosed which couple in each case one elevator car with the associated counterweight, said compensation ropes or compensation belts being guided around by means of a guide roller arrangement which is arranged below the elevator cars and consequently extending below the elevator car and the counterweight at least over a large part of their length.

WO 2009/080538 A1 describes an elevator installation where the first compensation ropes are secured to a first cable end on the floor of the shaft and to a second cable end on a weighted body or also on the floor of the shaft. Such a configuration requires an expensive cable guiding means for the first compensation ropes.

Therefore, a need exists for simpler cables or belt guiding means for the first compensation rope or compensation belts in elevator systems that employ two cars in one shaft.

DETAILED DESCRIPTION

Figure 1:
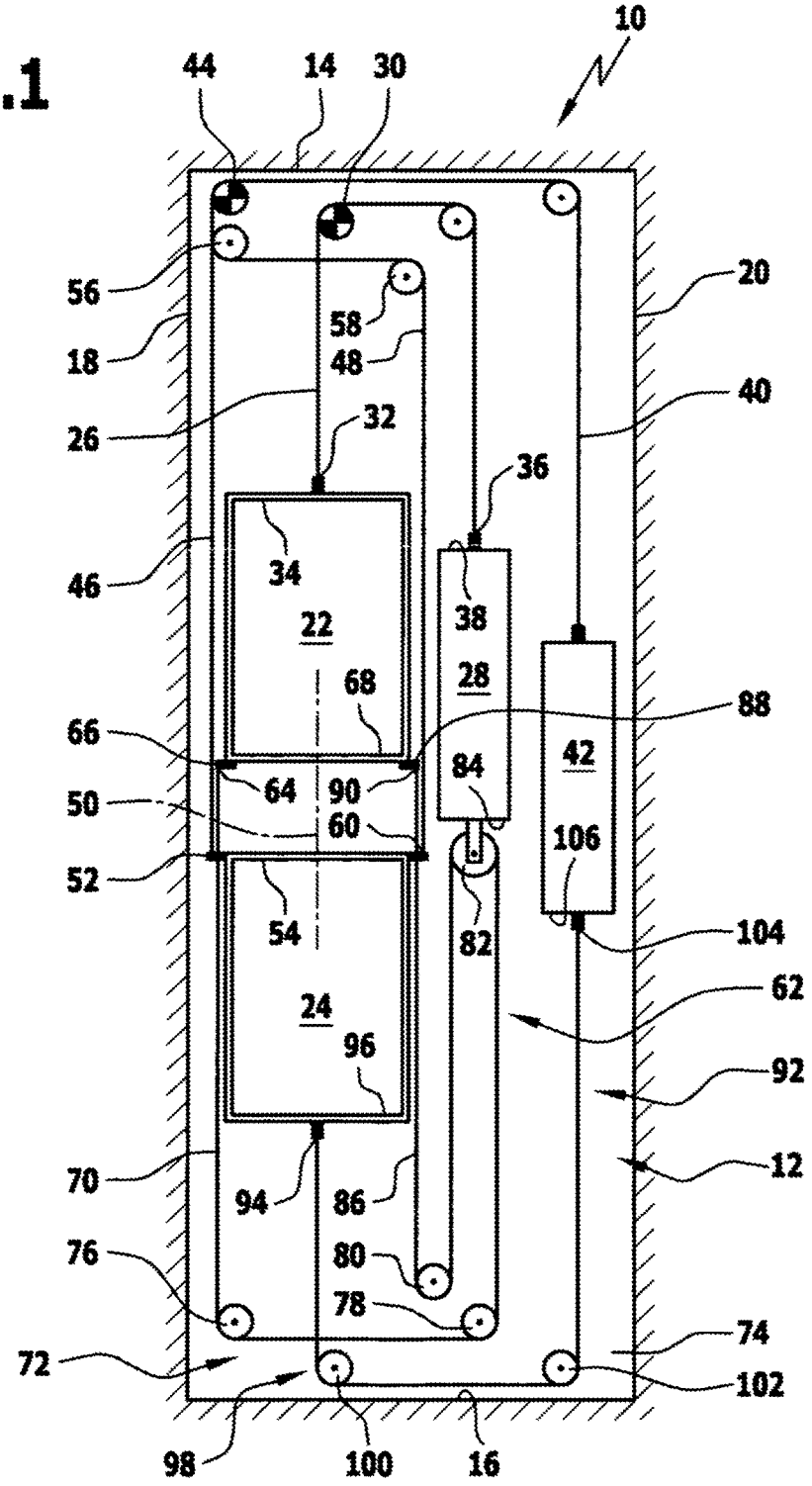
FIG. 1 is a schematic side view of an example elevator installation.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

The present disclosure generally concerns elevator installations that have a shaft in which a first elevator car and a second elevator car arranged below the first elevator car are separately movable up and down in a vertical direction along a common guideway. In some examples, the first elevator car may be coupled to a first counterweight by way of first suspension ropes or suspension belts, which can be guided by a first traction sheave arranged above the two elevator cars and by first compensation ropes or compensation belts, which can be guided by a first guide pulley arrangement arranged below the two elevator cars. The second elevator car may be coupled to a second counterweight by way of second suspension ropes or suspension belts, which can be guided by a second traction sheave arranged above the two elevator cars and by second compensation ropes or compensation belts, which can be guided by a second guide pulley arrangement arranged below the two elevator cars.

Some example first compensation ropes or compensation belts for elevator systems may comprise a first and a second cable or belt end, wherein they are secured by way of both cable or belt ends either on the first counterweight or on the bottom surface of the first elevator car and are guided around at least one roller which is arranged on the bottom surface of the first elevator car or around at least one roller which is arranged on the first counterweight. Furthermore, those having ordinary skill in the art will understand that the terms 'belt,' 'cable,' and 'rope' may be used interchangeably in the claims. Likewise, those having ordinary skill in the art will understand that the terms 'installation' and 'system' may be used interchangeably in the claims.

In the case of the elevator installation according to the invention, the compensation ropes or compensation belts assigned to the first elevator car are secured by way of their two cable or belt ends either on the first counterweight or on the bottom surface of the first elevator car. Proceeding from a first cable or belt end, the first compensation ropes or compensation belts extend over the first guide roller arrangement and the at least one roller. The first compensation ropes or compensation belts are guided around the at least one roller, and proceeding from the at least one roller, the first compensation ropes or compensation belts run back to the first guide roller arrangement and extend from the first guide roller arrangement as far as the second cable or belt end. The two cable or belt ends can be secured, for example, on the first counterweight. In the case of a development of this type, the at least one roller is rotatably mounted on the bottom surface of the first elevator car. As an alternative to this, it can be provided that the two cable or belt ends of the first compensation rope or compensation belts are secured on the bottom surface of the first elevator car. In the case of a development of this type, at least one roller is rotatably mounted on the first counterweight. In both cases, the common securement of the two cable or belt ends on the first counterweight or on the bottom surface of the first elevator car and the guiding of the first compensation ropes or compensation belts around at least one roller, which is rotatably mounted on the bottom surface of the first elevator car or on the first counterweight, enable a structurally simple cable guiding means for the first compensation ropes or compensation belts. This makes it possible to reduce the costs for the elevator installation.

Over and above this, the advantage of the elevator installation according to the invention is that the cable guiding means of the first compensation ropes or compensation belts is able to be realized in a very space-saving manner.

Over and above this, the securing or guiding of the first compensation ropes or compensation belts on the bottom surface of the first elevator car enables individual side regions of the first elevator car to be kept free of any cables and belts.

It is advantageous when the first compensation ropes or compensation belts comprise two cable or belt portions, between which the second elevator car is arranged. As already mentioned, the second elevator car is positioned below the first elevator car, and, as a result of the arrangement of the second elevator car between the two cable or belt portions of the first compensation ropes or compensation belts, the cable or belt portions of the first compensation ropes or compensation belts can extend on two different sides of the second elevator car. The second elevator car is consequently not impaired by the first compensation ropes or compensation belts and the cable guiding means of the first compensation ropes or compensation belts only requires a small amount of expenditure. In particular, the number of guide rollers used for the cable guiding means of the first compensation ropes or compensation belts can be kept low.

It is particularly favorable when the two cable or belt portions of the first compensation ropes or compensation belts are arranged on opposite sides of the second elevator car. It can be provided, in particular, that the two cable or belt portions are arranged in a point-symmetrical manner with respect to a center axis of the second elevator car.

A particularly simple cable guiding means of the first compensation ropes or compensation belts is obtained in the case of an advantageous development of the invention in that the two cable or belt portions of the first compensation ropes or compensation belts extend outside the vertical projection surface of the first elevator car in the vertical direction from the first elevator car as far as the first guide pulley arrangement. The positioning of the two cable or belt portions outside the vertical projection surface of the first elevator car ensures in a structurally simple manner that the second elevator car, which is arranged below the first elevator car, is not impaired by the two cable or belt portions. The vertical progression of the two cable or belt portions in the region between the first elevator car and the first guide roller arrangement simplifies the cable guiding means of the first compensation ropes or compensation belts, it being possible for additional guide rollers to be omitted in said region.

A particularly space-saving arrangement of the first compensation ropes or compensation belts is obtained in the case of a preferred development in that that the first compensation ropes or compensation belts extend inside the vertical projection surface of the first counterweight in the vertical direction from the first counterweight as far as the first guide pulley arrangement. The advantage, over and above this, of the vertical progression of the first compensation ropes or compensation belts in the region between the first counterweight and the first guide roller arrangement is that additional guide rollers are able to be omitted in said region.

In a preferred manner, the at least one roller, about which the first compensation ropes or compensation belts are guided, is arranged below the first counterweight.

It is advantageous when the cable or belt ends of the first compensation ropes or compensation belts are secured on first fastening members which protrude laterally outward from the first elevator car on opposite sides of the first elevator car. Proceeding from the first fastening members, the first compensation ropes or compensation belts can be guided past the second elevator car which is arranged below the first elevator car. In this connection, they can extend from the first fastening members down in the vertical direction to the first guide roller arrangement.

Securing the first compensation ropes or compensation belts on fastening members which are positioned on the first elevator car makes it possible to position the first elevator car at a rather small spacing from the second elevator car.

The first guide roller arrangement is arranged in a favorable manner in a shaft pit of the shaft.

The first guide pulley arrangement can comprise at least one guide roller which is retained in the shaft pit so as to be adjustable or non-adjustable in the vertical direction.

In the case of an advantageous development of the invention, the first guide pulley arrangement comprises several guide rollers, wherein all the guide rollers are rotatably mounted on boundaries of the shaft. The guide rollers can be rotatably mounted, for example, on shaft walls or even on a shaft floor of the shaft.

No more details have been given up to now concerning the securing of the second compensation ropes or compensation belts which are assigned to the second elevator car. In the case of an advantageous embodiment, the second compensation ropes or compensation belts are secured by way of a first cable or belt end on the second elevator car and by way of a second cable or belt end on the second counterweight.

In the case of a preferred embodiment of the invention, the first suspension ropes or suspension belts are secured by way of a first cable or belt end on the first elevator car and by way of a second cable or belt end on the first counterweight. As an alternative to this, it can be provided that the first suspension ropes or suspension belts are guided around a roller which is held on the first elevator car and/or on the first counterweight.

The second suspension ropes or suspension belts are secured in a favorable manner on the second elevator car and on the second counterweight. As an alternative to this, it can be provided that the second suspension ropes or suspension belts are guided around at least one roller which is held on the second elevator car and/or on the second counterweight.

It is particularly advantageous when the second suspension ropes or suspension belts realize two suspension rope or suspension belt trains, between which the first elevator car is arranged. Proceeding from the second elevator car, the two suspension rope or suspension belt trains can extend along different sides of the first elevator car which is positioned above the second elevator car.

It can be provided, in particular, that the two suspension rope or suspension belt trains of the second suspension ropes or suspension belts are arranged in a point-symmetrical manner with respect to a center axis of the first elevator car.

In the case of an advantageous development of the invention, second fastening members, which protrude laterally outward from the second elevator car on opposite sides of the second elevator car, are arranged on the second elevator car, wherein the two suspension rope or suspension belt trains of the second suspension rope or suspension belt are secured on the second elevator car by means of the second fastening members.

In the case of an advantageous embodiment of the invention, a particularly space-saving guiding means of both the suspension ropes or suspension belts and of the compensation ropes or compensation belts of the two elevator cars is obtained in that the first compensation ropes or compensation belts are held by means of a pair of first fastening members or first rollers on the bottom surface of the first elevator car and the suspension ropes or suspension belts of the second elevator car are secured by means of a pair of second fastening members on the second elevator car—preferably on the top surface thereof—, an imaginary connecting line of the first fastening members or of the first roller, in a vertical projection, intersecting an imaginary connecting line of the second fastening members. With reference to a common center axis of the two elevator cars, the imaginary connecting line of the first fastening members or of the first rollers consequently comprises a different angular position than the imaginary connecting line of the second fastening members. The imaginary connecting lines can be aligned, in this connection, perpendicular with respect to one another. It is particularly advantageous, however, when the imaginary connecting lines intersect one another in an X-shaped manner, the angle of intersection between the two imaginary connecting lines being smaller than 90°. For example, the angle of intersection can be between 20 and 70°. It has been shown that a particularly space-saving arrangement of the first compensation ropes or compensation belts and of the second suspension ropes or suspension belts is made possible as a result.

FIG. 1 shows a schematic representation of a first advantageous embodiment of an elevator installation according to the invention which is provided as a whole with the reference 10. The elevator installation 10 includes a shaft 12 which extends from a shaft ceiling 14 as far as to a shaft floor 16 and comprises several shaft walls, just a first shaft wall 18 and a second shaft wall 20 being visible in FIG. 1.

The elevator installation 10 is explained below by the example of the use of suspension ropes and compensation ropes for the sake of simplicity. However, suspension belts and compensation belts could also be used instead of the suspension ropes and compensation ropes. It is obvious that the invention extends in the same manner to both suspension ropes and compensation ropes and to suspension belts and compensation belts.

A first elevator car 22 and a second elevator car 24 are movable up and down in the shaft 12 along common guide rails, which are known per se and consequently not shown in the drawing so to achieve a better overview. The first elevator car 22 is arranged above the second elevator car 24 and is coupled with a first counterweight 28 by means of first suspension ropes 26. The first suspension ropes 26 are guided by means of a first motor-driven rotatable traction sheave 30, by means of which the first elevator car 22 is able to be moved vertically up and vertically down in the usual manner.

The first suspension ropes 26 are secured centrally on an elevator car ceiling 34 of the first elevator car 22 by means of a first suspension rope end 32 and the first suspension ropes 26 are secured centrally on a top surface 38 of the first counterweight 28 by means of a second suspension rope end 36.

The second elevator car 24 is coupled with a second counterweight 42 by means of second suspension ropes 40 and is guided by means of a second traction sheave 44, by means of which the second elevator car 24 is able to be moved vertically up and down.

The second suspension ropes 40 realize a first suspension rope train 46 and a second suspension rope train 48 which extend between the second traction sheave 44 and the second elevator car 24, the first elevator car 22 being positioned between the first suspension rope train 46 and the second suspension rope train 48 of the second suspension ropes. The two suspension rope trains 46, 48 extend on opposite sides of the first elevator car 22, being arranged at the height of the first elevator car 22 in a point-symmetrical manner with respect to a common center axis 50 of the two elevator cars 22, 24.

Proceeding from the second traction sheave 44, the first suspension rope train 46 extends vertically down as far as a first fastening member 52 which is arranged on an elevator car ceiling 54 of the second elevator car 24 and protrudes laterally outward from the second elevator car 24.

Proceeding from the second traction sheave 44, the second suspension rope train 48 is guided by means of a first guide roller 56 and a second guide roller 58 to a second fastening member 60 which is arranged on the elevator car ceiling 54 and protrudes laterally outward from the second elevator car 24 on the side of the second elevator car 24 remote from the first fastening member 52. The two fastening members 52 and 60 are arranged in a point-symmetrical manner with respect to the common center axis of the two elevator cars 22, 24.

To compensate for the weight of the first suspension ropes 26, the elevator installation 10 comprises first compensation ropes 62 which couple the first elevator car 22 with the first counterweight 28 on the side remote from the first suspension ropes 26. The first compensation ropes 62 comprise a first cable end 64 which is secured on an elevator car floor 68 of the first elevator car 22 by means of a third fastening member 66, the third fastening member 66 protruding laterally outward from the first elevator car 22.

Proceeding from the third fastening member 66, a first cable portion 70 of the first compensation ropes 62 extends vertically down as far as a first guide roller arrangement 72, which is arranged in the region of a shaft pit 74 of the shaft 12 adjacent to the shaft floor 16. The first guide roller arrangement 72 includes a third guide roller 76 and a fourth guide roller 78, both of which are mounted in a freely rotatable manner on the shaft floor 16 or on shaft walls by means of bearing means which are not shown in the drawing and are known per se to the expert. Over and above this, the first guide roller arrangement 72 comprises a fifth guide roller 80 which is also mounted in a freely rotatable manner on the shaft floor 16 or on shaft walls by means of bearing elements which are not shown in the drawing.

The first cable portion 70 is guided around the third guide roller 76 and the fourth guide roller 78. Proceeding from the fourth guide roller 78, the first cable portion 70 extends up in the vertical direction to a roller 82 which is mounted in a freely rotatable manner on a bottom surface 84 of the first counterweight 28. From the roller 82, a second cable portion 86 of the first compensation ropes 62 extends vertically down as far as the fifth guide roller 80. The second cable portion 86 is guided around the fifth guide roller 80 and, proceeding from the fifth guide roller 80, extends up in the vertical direction as far as a fourth fastening member 88, by way of which a second cable end 90 of the first compensation ropes 62 is secured on the first elevator car 22. The fourth fastening member 88 is arranged at the height of the elevator car floor 68 of the first elevator car 22 and protrudes laterally outward from the first elevator car 22. The third fastening member 66 and the fourth fastening member 88 are arranged in a point-symmetrical manner with respect to one another with reference to the common center axis 50 of the two elevator cars 22, 24. An imaginary connecting line, which connects the third fastening member 66 to the fourth fastening member 88, intersects, in this connection, in a vertical projection, an imaginary connecting line which connects the first fastening member 52 to the second fastening member 60. In a vertical projection, the two connecting lines are aligned in an X-shaped manner with respect to one another, the angle of intersection between the two imaginary connecting lines being between approximately 20° and approximately 70°, in particular between approximately 25° and approximately 60°.

As already mentioned, the weight of the first suspension ropes 26 is compensated for by means of the first compensation ropes 62. This ensures that the first suspension ropes 26 are not able to slip over the first traction sheave 30.

To be able to compensate for the weight of the second suspension ropes 40, the elevator installation 10 comprises second compensation ropes 92 which couple the second elevator car 24 with the second counterweight 42 on the side of the second elevator car 24 remote from the second suspension ropes 40. A first cable end 94 is secured centrally on an elevator car floor 96 of the second elevator car 24. Proceeding from the first cable end 94, the second compensation ropes 92 extend down in the vertical direction to a second guide roller arrangement 98 which is arranged in the region of the shaft pit 74 and comprises a sixth guide roller 100 and a seventh guide roller 102. Proceeding from the first cable end 94, the second compensation ropes 92 are guided around the sixth guide roller 100 and the seventh guide roller 102. From the seventh guide roller 102, the second compensation ropes 92 extend up in the vertical direction, being secured by way of a second cable end 104 on a bottom surface 106 of the second counterweight 42.

The two elevator cars 22, 24 can be positioned at a very small spacing from one another and, as a result of the X-shaped arrangement of the imaginary connecting lines which connect the fastening members 52 and 60 or the fastening members 66 and 88 with one another, mutual obstruction of the suspension rope trains 46, 48 of the second suspension ropes 40 by the cable portions 70, 86 of the first compensation ropes 62 is excluded.

Figure 2:
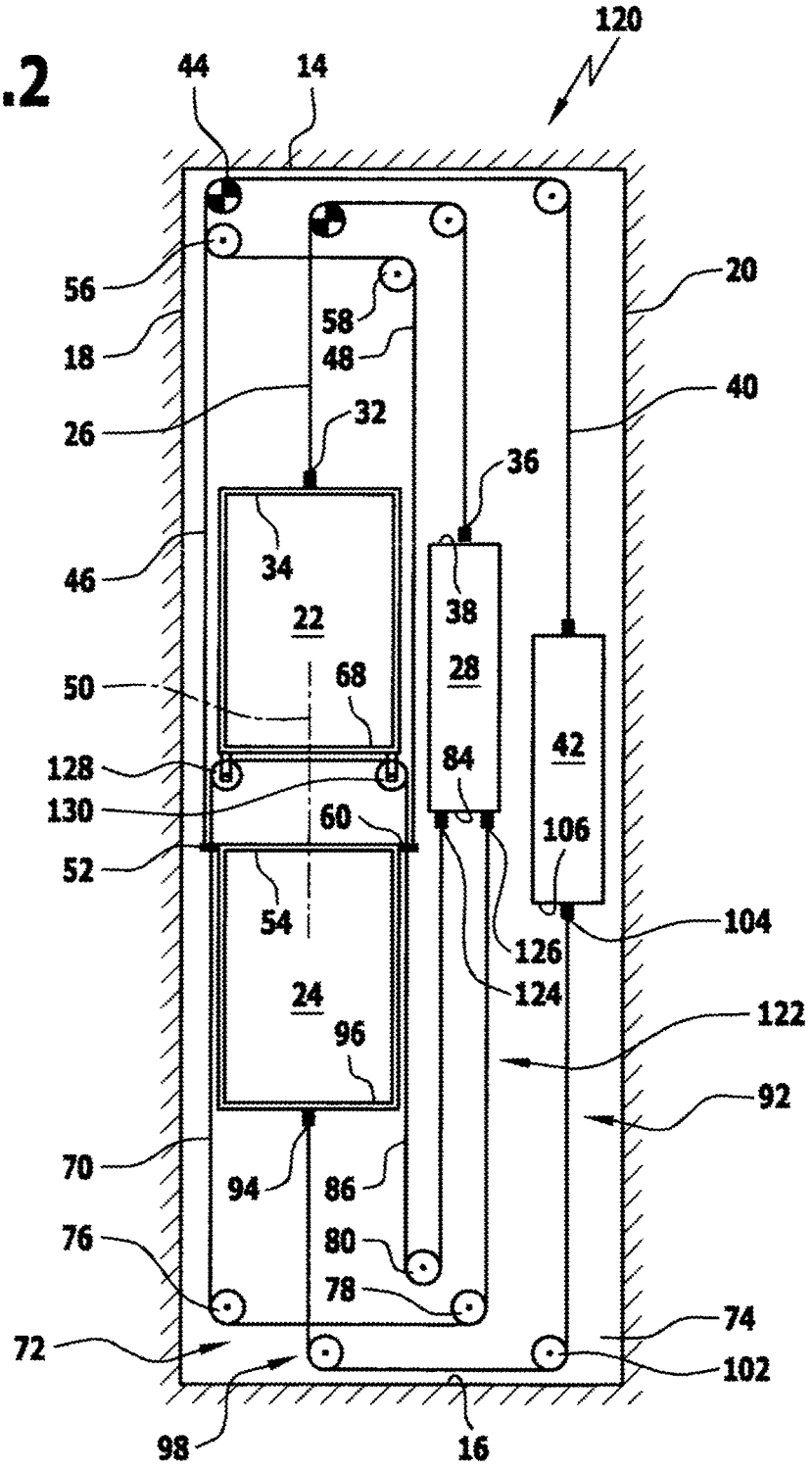
FIG. 2 is a schematic side view of another example elevator installation.

FIG. 2 shows a schematic representation of a second advantageous embodiment of an elevator installation according to the invention which is given the reference 120 as a whole. The elevator installation 120 is realized in an extensively identical manner to the preceding elevator installation 10 which has been explained with reference to FIG. 1. These same references as in FIG. 1 are consequently used in FIG. 2 for identical components and reference is made to the preceding explanations with reference to said components to avoid repetition.

In the case of the elevator installation 10 explained above, the first cable end 64 and the second cable end 90 of the first compensation ropes 62 are secured on the first elevator car 22 and the first compensation ropes 62 are guided around the first roller 82 which is rotatably mounted on the first counterweight 28. In contrast to this, first compensation ropes 122, which are secured by way of a first cable end 124 and a second cable end 126 on the bottom surface 84 of the first counterweight 28, are used in the case of the elevator installation 120 shown in FIG. 2. The first compensation ropes 122, in the case of the elevator installation 20, are guided around a second roller 128 and a third roller 130 below the elevator car floor 68. Proceeding from the first cable end 124, the first compensation ropes 122 extend vertically down inside the vertical projection of the first counterweight 28 as far as the fifth guide roller 80, around which they are guided. Proceeding from the fifth guide roller, the first compensation ropes 122 extend up in the vertical direction as far as the third roller 130, being guided past a side of the second elevator car 24. Proceeding from the third guide roller 130, the first compensation ropes 122 extend in the horizontal direction below the elevator car floor 28 of the first elevator car 22 as far as the second roller 128, from which the first compensation ropes 122 extend down in the vertical direction as far as the third guide roller 76. From the third guide roller 76, the first compensation ropes 122 extend in the horizontal direction to the fourth guide roller 78, from which the first compensation ropes 122 extend as far as the second cable end 126 which is secured on the bottom surface 84 of the first counterweight 28.

In the case of the elevator installation 120, the imaginary connecting line, which connects the first fastening member 52 to the second fastening member 60, intersects, in a vertical projection, the imaginary connecting line which connects the second roller 128 to the third roller 130, the two imaginary connecting lines being aligned in an X-shaped manner with respect to one another and comprising an angle of intersection within the range of between approximately 20° and approximately 70°, in particular an angle of intersection within the range of between approximately 25° and approximately 60°. As a result of the first and second fastening members 52, 60 and the second and third rollers 128, 130 being arranged in this manner, mutual obstruction of the suspension rope trains 46, 48 of the second suspension ropes 40 by the first compensation ropes 122 can be excluded and the second suspension ropes 40 and the first compensation ropes 122 are able to be arranged in a very space-saving manner.

Both in the case of the elevator installation 10 shown schematically in FIG. 1 and in the case of the elevator installation 120 shown schematically in FIG. 2, the cable guiding means of the first compensation ropes 62 or 122 is achievable in a cost-efficient manner and all the suspension ropes and compensation ropes are able to be arranged in a space-saving manner in the shaft 12.

What is claimed is:

1. An elevator system comprising:

a shaft in which a first elevator car and a second elevator car are separately movable up and down in a vertical direction along a common guideway, wherein the first elevator car is coupled to a first counterweight by first suspension ropes that are guided by a first traction sheave positioned above the first and second elevator cars, and by first compensation ropes that are guided by a first guide pulley arrangement positioned below the first and second elevator cars, wherein the second elevator car is coupled to a second counterweight by second suspension ropes that are guided by a second traction sheave positioned above the first and second elevator cars, and by second compensation ropes that are guided by a second guide pulley arrangement positioned below the first and second elevator cars, wherein the first compensation ropes comprise a first rope end and a second rope end, with the first compensation ropes being secured by way of the first and the second rope ends either on the first counterweight or at a bottom surface of the first elevator car, wherein the first compensation ropes are guided around at least one roller disposed on the bottom surface of the first elevator car or on the first counterweight.

2. The elevator system of claim 1 wherein the first compensation ropes comprise two rope portions between which the second elevator car is positioned.

3. The elevator system of claim 2 wherein the two rope portions extend along opposite sides of the second elevator car.

4. The elevator system of claim 2 wherein the two rope portions extend outside a vertical projection surface of the first elevator car in the vertical direction from the first elevator car to the first guide pulley arrangement.

5. The elevator system of claim 1 wherein the first compensation ropes extend inside a vertical projection surface of the first counterweight in the vertical direction from the first counterweight to the first guide pulley arrangement.

6. The elevator system of claim 1 wherein the at least one roller is disposed below the first counterweight.

7. The elevator system of claim 1 wherein the first and the second rope ends of the first compensation ropes are secured on fastening members that protrude laterally outward from the first elevator car on opposite sides of the first elevator car.

8. The elevator system of claim 1 wherein the first guide pulley arrangement is positioned in a shaft pit of the shaft.

9. The elevator system of claim 1 wherein the first guide pulley arrangement comprises a plurality of guide rollers that are rotatably mounted on boundaries of the shaft.

10. The elevator system of claim 1 wherein the second compensation ropes are secured by a first rope end on the second elevator car and by a second rope end on the second counterweight.

11. The elevator system of claim 1 wherein the first suspension ropes are secured by a first rope end on the first elevator car and by a second rope end on the first counterweight.

12. The elevator system of claim 1 wherein the second suspension ropes comprise two suspension rope trains between which the first elevator car is positioned.

13. The elevator system of claim 12 further comprising fastening members that protrude laterally outward from the second elevator car on opposite sides of the second elevator car, wherein the two suspension rope trains are secured on the second elevator car by the fastening members.

14. An elevator system comprising:

a shaft;

a first elevator car;

a second elevator car, wherein the first and second elevator cars are separately movable up and down in the shaft along a common guideway, a first counterweight coupled to the first elevator car by at least one first suspension rope that is guided by a first traction sheave disposed above the first and second elevator cars, wherein the first counterweight is coupled to the first elevator car by at least one first compensation rope that is guided by a first guide pulley arrangement disposed below the first and second elevator cars;

a second counterweight coupled to the second elevator car by at least one second suspension rope that is guided by a second traction sheave disposed above the first and second elevator cars, wherein the second counterweight is coupled to the second elevator car by at least one second compensation rope that is guided by a second guide pulley arrangement disposed below the first and second elevator cars, wherein a first end and a second end of the at least one first compensation rope is secured to the first counterweight or the first elevator car, wherein the at least one first compensation rope is guided around at least one roller disposed on the bottom surface of the first elevator car or the first counterweight.

* * * * *